US007892000B1

(12) United States Patent
Yen

(10) Patent No.: US 7,892,000 B1
(45) Date of Patent: Feb. 22, 2011

(54) CONNECTOR LOCKING BASE STRUCTURE OF LED LAMP

(76) Inventor: Hsu Li Yen, 3F-2, No. 13, Wucyuan 1st Rd., Sinjhuang City, Taipei County 242 (TW)

( * ) Notice: Subject to any disclaimer, the term of this patent is extended or adjusted under 35 U.S.C. 154(b) by 0 days.

(21) Appl. No.: 12/850,791

(22) Filed: Aug. 5, 2010

(51) Int. Cl.
*H01R 33/02* (2006.01)

(52) U.S. Cl. ..... 439/236

(58) Field of Classification Search ..... 439/236, 439/240; 362/647–651, 377, 378, 457
See application file for complete search history.

(56) References Cited

U.S. PATENT DOCUMENTS 5,700,154 A * 12/1997 Geary ..... 439/236
7,641,364 B2 * 1/2010 Abbondanzio et al. ..... 362/295
2006/0098440 A1 * 5/2006 Allen ..... 362/294
2009/0027903 A1 * 1/2009 Yu ..... 362/378
2010/0002451 A1 * 1/2010 Reynolds ..... 362/363

* cited by examiner

*Primary Examiner*—Tho D Ta
(74) *Attorney, Agent, or Firm*—Rosenberg, Klein & Lee

(57) ABSTRACT

A connector locking base structure of an LED lamp includes a connector locking base having a conventional lamp connector and a locking base coupled together such that a threaded end of a cap of the LED lamp can be screwed to the locking base of the connector locking base. The conventional lamp connector of the connector locking base can be inserted into a socket for use with a conventional lamp, thereby allowing power to be supplied to the LED lamp for emission of light. Grooves formed in a casing of the conventional lamp connector are engaged with hooks of the locking base. A screw hole is centrally formed in the locking base. The hooks are provided on the inner side of the locking base and engaged with the grooves of the conventional lamp connector, respectively, to thereby form the connector locking base.

1 Claim, 2 Drawing Sheets

CONNECTOR LOCKING BASE STRUCTURE OF LED LAMP

BACKGROUND OF THE INVENTION

1. Technical Field

The present invention relates LED lamps, and more particularly, to a connector locking base of an LED lamp.

2. Description of Related Art

The lighting of a lamp is intended to illuminate a space and thereby ensure an unblocked view thereof. Hence, the stability of the light emitted from the lamp has a direct effect on the human eye. Also, there are growing concerns for the manufacturing process of lamps, raw materials used in the process, environmental protection-related issues regarding the recycling of the raw materials, and high power consumption required for the lighting of the lamps.

Recently, there are some instances of unfavorable international coverage of the negative effect of conventional lamps on the human health and environmental protection. At present, the international community is replacing conventional lamps with LED lamps. LED lamps are absolutely free from problems with environmental protection and health hazards. Also, LED lamps excel conventional lamps in the brightness and stability of illumination, not to mention that LED lamps are extremely power-saving. Hence, LED lamps are very popular with consumer.

To allow LED lamps to substitute for conventional lamps, enable costs cutting, and meet consumer needs, the inventor of the present invention continuously explored the way to enable a conventional lamp base to supply power to an LED lamp for illumination, and eventually devised an improved structure.

Examiners of related patent authorities are hereby requested to refer to the appended drawings and embodiment when looking into the structures, methods, objectives, and spirit of the present invention, so as to gain insight into the present invention.

BRIEF SUMMARY OF THE INVENTION

A connector locking base structure of an LED lamp, characterized in that the connector locking base structure includes a connector locking base having a conventional lamp connector and a locking base coupled together such that a threaded end of a cap of the LED lamp can be screwed to the locking base of the connector locking base. The conventional lamp connector of the connector locking base can be inserted into a socket for use with a conventional lamp, thereby allowing power to be supplied to the LED lamp for emission of light. Grooves formed in a casing of the conventional lamp connector are engaged with hooks of the locking base. A screw hole is centrally formed in the locking base. The hooks are provided on the inner side of the locking base and engaged with the grooves of the conventional lamp connector, respectively, to thereby form the connector locking base. The threaded end of the cap of the LED lamp can be screwed to the screw hole centrally formed in the locking base.

DETAILED DESCRIPTION OF THE INVENTION

Figure 1:
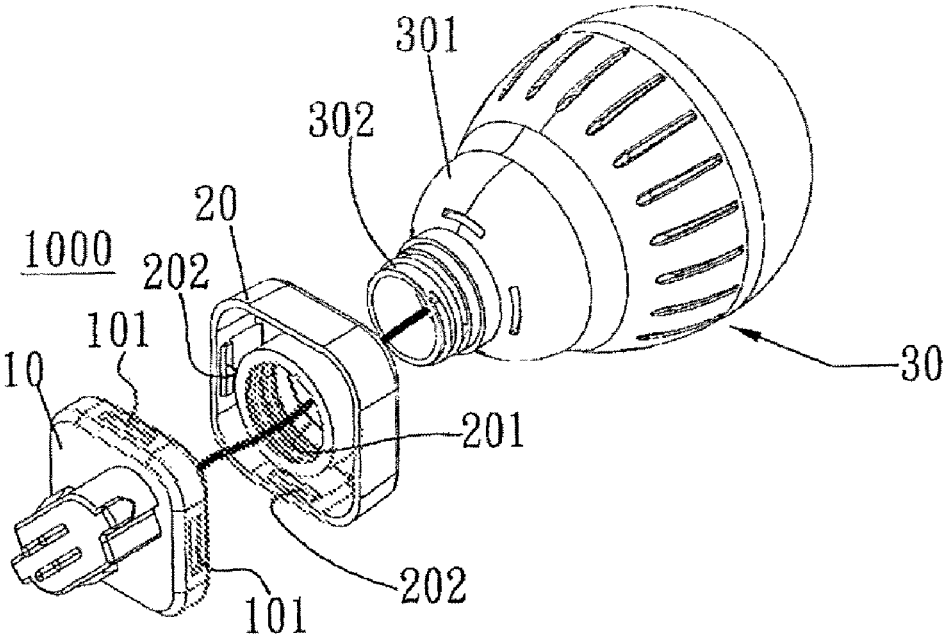
FIG. 1 is an exploded perspective view of a connector locking base structure of an LED lamp of the present invention.
Figure 2:
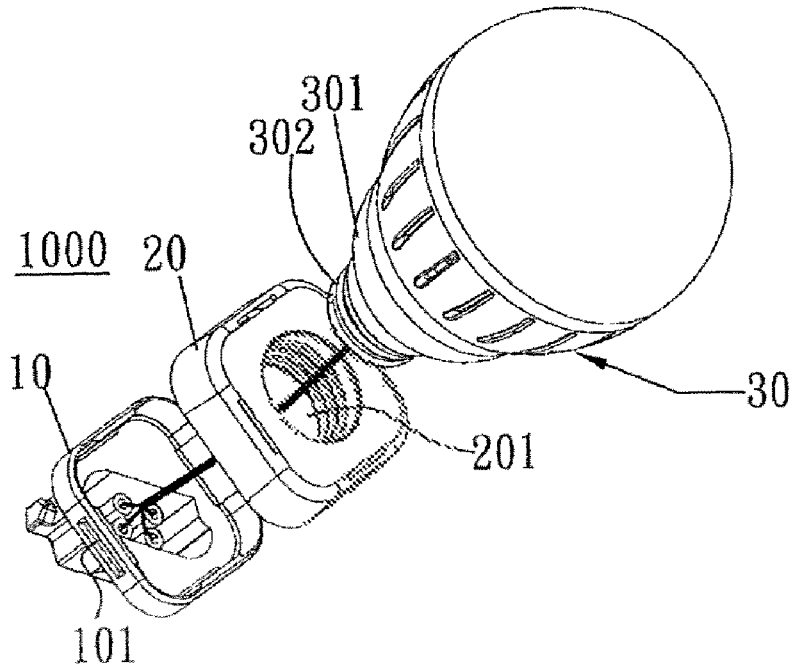
FIG. 2 is another exploded perspective view of the connector locking base structure of an LED lamp of the present invention.

FIG. 1 is an exploded perspective view of a connector locking base structure of an LED lamp of the present invention. As shown in the drawing (see also FIG. 2), a connector locking base 1000 comprises a conventional lamp connector 10 and a locking base 20 coupled together. A plurality of grooves 101 formed in a casing of the conventional lamp connector 10 are engaged with a plurality of hooks 202 of the locking base 20 to thereby form the connector locking base 1000. A screw hole 201 is centrally formed in the locking base 20. The hooks 202 are provided on the inner side of the locking base 20 and engaged with the grooves 101 of the conventional lamp connector 10, respectively. Hence, the grooves 101 of the conventional lamp connector 10 are engaged with the hooks 202 of the locking base 20 to thereby form the connector locking base 1000. An LED lamp 30 has a cap 301. The cap 301 is coupled to a threaded end 302 (see also FIG. 3). The threaded end 302 can be screwed to the screw hole 201 formed in the locking base 20 of the connector locking base 1000.

Figure 3:
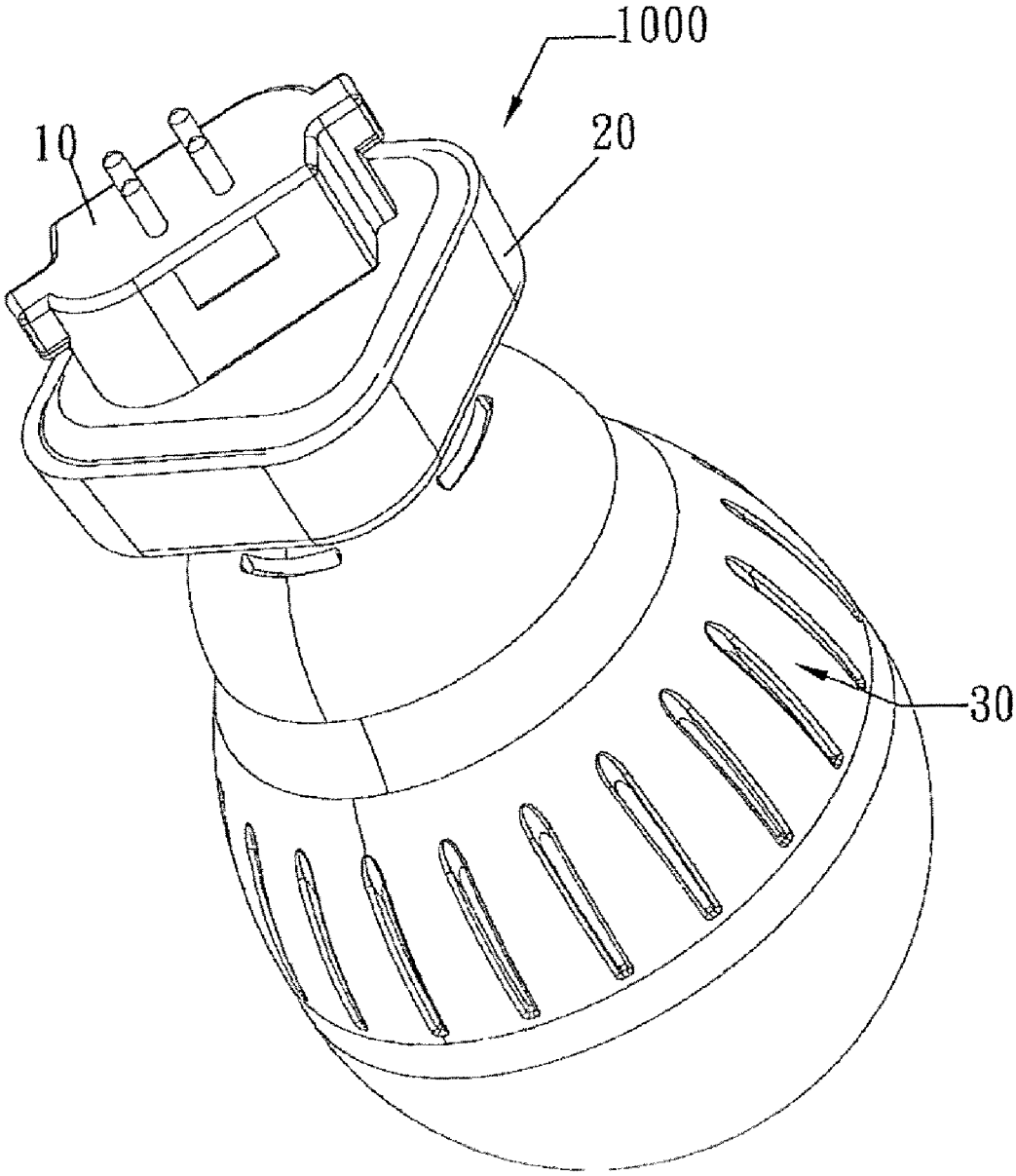
FIG. 3 is an assembled perspective view of the connector locking base structure of an LED lamp of the present invention.

FIG. 3 is an assembled perspective view of the connector locking base structure of an LED lamp of the present invention. As shown in the drawing, the LED lamp 30 and the connector locking base 1000 are coupled together to form a unitary structure. The conventional lamp connector 10 of the connector locking base 1000 can be inserted into a socket for use with a conventional lamp; hence, power can be supplied to the LED lamp 30 for emission of light.

In conclusion, the present invention demonstrates novel effects, involves an inventive step, has never been published or applied, and has high industrial applicability. Hence, the applicant of the present invention hereby files a patent application with related patent authorities and expects that the related patent authorities will allow the patent application.

It should be noted that the above descriptions pertain to the preferred embodiment of the present invention. All changes which are made to the preferred embodiment of the present invention according to the concepts thereof and bring about a desired function or effect without departing from the spirit embodied in the specification and drawings should be deemed falling within the scope of the present invention.

What is claimed is:

1. A connector locking base structure of an LED lamp, essentially characterized in that the connector locking base structure comprises a connector locking base further comprising a conventional lamp connector and a locking base coupled together, a plurality of grooves disposed in a casing of the conventional lamp connector being engaged with a plurality of hooks of the locking base to thereby form the connector locking base, a screw hole being centrally disposed in the locking base, the hooks being provided on an inner side of the locking base and engaged with the grooves of the conventional lamp connector, respectively, the grooves of the conventional lamp connector being engaged with the hooks of the locking base to thereby form the connector locking base, the LED lamp having a cap and a threaded end coupled thereto, and the threaded end being configured to be screwed to the screw hole in the locking base of the connector locking base.

* * * * *